US011624174B2

(12) United States Patent
He et al.

(10) Patent No.: US 11,624,174 B2
(45) Date of Patent: Apr. 11, 2023

(54) COMBINED SHOWER

(71) Applicant: XIAMEN DELMEI SANITARY WARE CO., LTD., Xiamen (CN)

(72) Inventors: Xusheng He, Xiamen (CN); Weilong Luo, Xiamen (CN); Chunhua Wang, Xiamen (CN); Yongqiang Yan, Xiamen (CN)

(73) Assignee: XIAMEN DELMEI SANITARY WARE CO., LTD., Xiamen (CN)

( * ) Notice: Subject to any disclaimer, the term of this patent is extended or adjusted under 35 U.S.C. 154(b) by 113 days.

(21) Appl. No.: 17/202,383

(22) Filed: Mar. 16, 2021

(65) Prior Publication Data

US 2022/0213673 A1 Jul. 7, 2022

(30) Foreign Application Priority Data

Jan. 6, 2021 (CN) ..... 202120026602.X

(51) Int. Cl.

| | |
|---|---|
| ***E03C 1/04*** | (2006.01) |
| ***B05B 1/18*** | (2006.01) |
| ***B05B 1/16*** | (2006.01) |
| ***E03C 1/02*** | (2006.01) |

(52) U.S. Cl.

CPC ..... *E03C 1/0408* (2013.01); *B05B 1/16* (2013.01); *B05B 1/185* (2013.01); *E03C 2001/026* (2013.01)

(58) Field of Classification Search

CPC .. B05B 1/16; B05B 1/18; B05B 1/185; B05B 15/60; B05B 15/62; B05B 15/65; E03C 1/0408

See application file for complete search history.

(56) References Cited

U.S. PATENT DOCUMENTS

| | | | | |
|---|---|---|---|---|
| 7,837,133 | B2 * | 11/2010 | Zhou | B05B 15/65 239/289 |
| 8,720,799 | B2 * | 5/2014 | Tseng | B05B 1/1636 239/443 |
| 9,631,348 | B2 * | 4/2017 | Huang | B05B 1/1636 |
| 2014/0054398 | A1 * | 2/2014 | Lev | B05B 1/185 239/443 |

* cited by examiner

*Primary Examiner* — Darren W Gorman

(74) *Attorney, Agent, or Firm* — Bayramoglu Law Offices LLC

(57) ABSTRACT

A combined shower includes a wall-mounted supporting arm, an over-head shower, and a hand-held shower. The over-head shower is fixed on the wall-mounted supporting arm. The hand-held shower is detachably fixed on the over-head shower through a hose. A switching button is provided on the over-head shower, and the switching button is configured to selectively switch on the over-head shower or the hand-held shower through a handle. Additionally, the over-head shower is provided with a mounting ring, the hand-held shower is provided with a central hole, and the hand-held shower is sleeved outside the mounting ring through the central hole, which ensures that the hand-held shower can be stably fixed on the over-head shower and can also be freely taken and used.

6 Claims, 4 Drawing Sheets

COMBINED SHOWER

CROSS REFERENCE TO THE RELATED APPLICATIONS

This application is based upon and claims priority to Chinese Patent Application No. 202120026602.X, filed on Jan. 6, 2021, the entire contents of which are incorporated herein by reference.

TECHNICAL FIELD

The present invention relates to a shower, and more particularly, to a combined shower.

BACKGROUND

In today's increasing need for improving people's quality of life, more features are sought after when it comes to shower equipment and features. People not only hope to enjoy the comfort of an over-head shower, but also hope to get the convenience of bathing brought by a hand-held shower, and a combined shower that can meet the two requirements. However, on the market, the over-head shower and the hand-held shower in the prior combined showers are usually installed separately. This leads to a complex installation process, which consists of drilling the wall several times in order to combine and fit the separate pieces together during the installation process which in turn can cause a long and the troublesome installation experience.

SUMMARY

In view of the above technical problems, an object of the present invention is to provide a combined shower with simple structure, low production cost and simple installation.

To achieve the above object, the present invention adopts the following technical solution. A combined shower includes a wall-mounted supporting arm, an over-head shower, and a hand-held shower. The over-head shower is fixed on the wall-mounted supporting arm. The hand-held shower is detachably fixed on the over-head shower through a hose. A switching button is further provided on the over-head shower, and the switching button is configured to selectively switch on the over-head shower or the hand-held shower.

Preferably, a mounting ring is provided at an end of the over-head shower away from a wall, and the switching button is rotatably arranged in the mounting ring. The top end of the switching button is provided with a handle.

Preferably, the hand-held shower is provided with a central hole, and the hand-held shower is sleeved outside the mounting ring through the central hole.

Preferably, a damping portion is fixedly provided on a peripheral wall of the mounting ring, and the damping portion is made of a flexible material or a magnetic material.

Preferably, the damping portion is provided with a plurality of friction ribs.

Preferably, the damping portion is sleeved on the mounting ring, or the damping portion is formed through a secondary injection molding. The damping portion is in interference fit with the central hole.

Preferably, the damping portion is made of a rubber material.

Preferably, a magnetic block is provided in the central hole, and the magnetic block magnetically cooperates with the damping portion made of the magnetic material.

The present invention has the following advantages.

In the combined shower of the present invention, only the wall-mounted supporting arm is fixed on the wall, then the over-head shower is fixed through the wall-mounted supporting arm, and the hand-held shower is detachably fixed on the mounting ring of the over-head shower.

Moreover, the switching button is configured to selectively switch on the over-head shower or the hand-held shower. Additionally, the over-head shower is provided with a mounting ring, the hand-held shower is provided with a central hole, and the hand-held shower is sleeved outside the mounting ring through the central hole, which ensures that the hand-held shower can be stably fixed on the over-head shower and can also be freely taken and used. The above technical solution makes the combined shower of the present invention have the advantages of simple structure, convenient installation and convenient use.

BRIEF DESCRIPTION OF THE DRAWINGS

The accompanying drawings described here are used to provide further understanding of the present invention and constitute a part of the present invention. Exemplary embodiments and description thereof of the present invention are used to illustrate the present invention, but do not constitute improper limitations to the present invention. In the drawings.

DETAILED DESCRIPTION OF THE EMBODIMENTS

In order to make the technical problem to be solved, the technical solution and advantages of the present invention clearer, the present invention will be further described in detail in conjunction with the drawings and embodiments. It should be understood that the specific embodiments described herein are intended to only explain the present invention and not limit the present invention.

Preferred Embodiment I of the Present Invention

Figure 1:
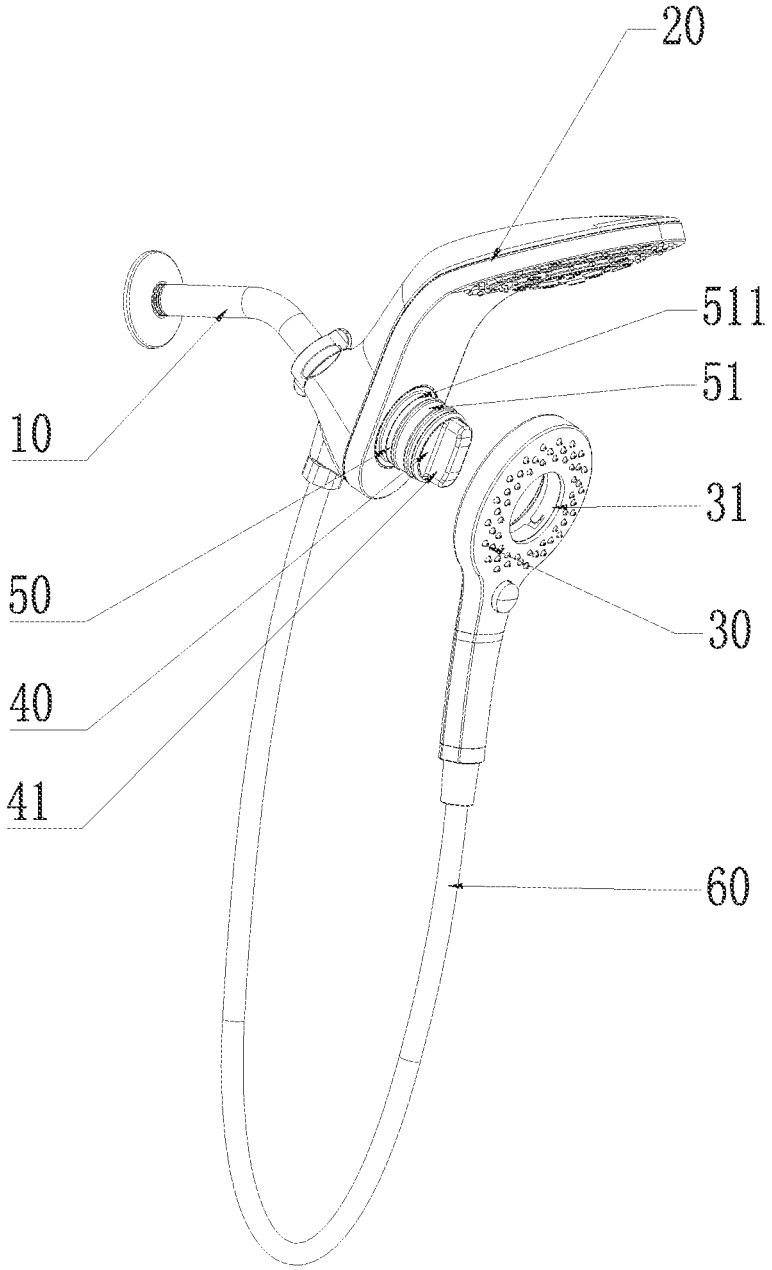
FIG. 1 is a schematic diagram of an overall structure of a hand-held shower separated from an over-head shower according to Embodiment I of the present invention.

Referring to FIG. 1, a combined shower of the present invention includes the wall-mounted supporting arm 10, the over-head shower 20, and the hand-held shower 30. The wall-mounted supporting arm 10 is fixed on the wall by a drilling hole in the wall. The over-head shower 20 is fixedly mounted on the wall-mounted supporting arm 10 by a thread or a snap joint. The mounting ring 50 is provided at an end of the over-head shower 20 positioned away from the wall, and the mounting ring 50 is provided with the switching button 40. The lower end of the over-head shower 20 may be connected to the hose 60, and the other end of the hose 60 is connected to the hand-held shower 30.

Specifically, the wall-mounted supporting arm 10 is connected to a water inlet pipe from the wall. The end of the wall-mounted supporting arm 10 positioned away from the wall is provided with a shunt valve (not shown), and a water passage of the shunt valve (not shown) is connected to the over-head shower 20 and the hand-held shower 30. Moreover, the switching button 40 is connected to the shunt valve (not shown) and is configured to switch the water passage of the shunt valve (not shown).

Specifically, the top end of the switching button 40 is provided with the handle 41, and the over-head shower 20 or the hand-held shower 30 is selectively switched on by rotating the handle 41.

Figure 2:
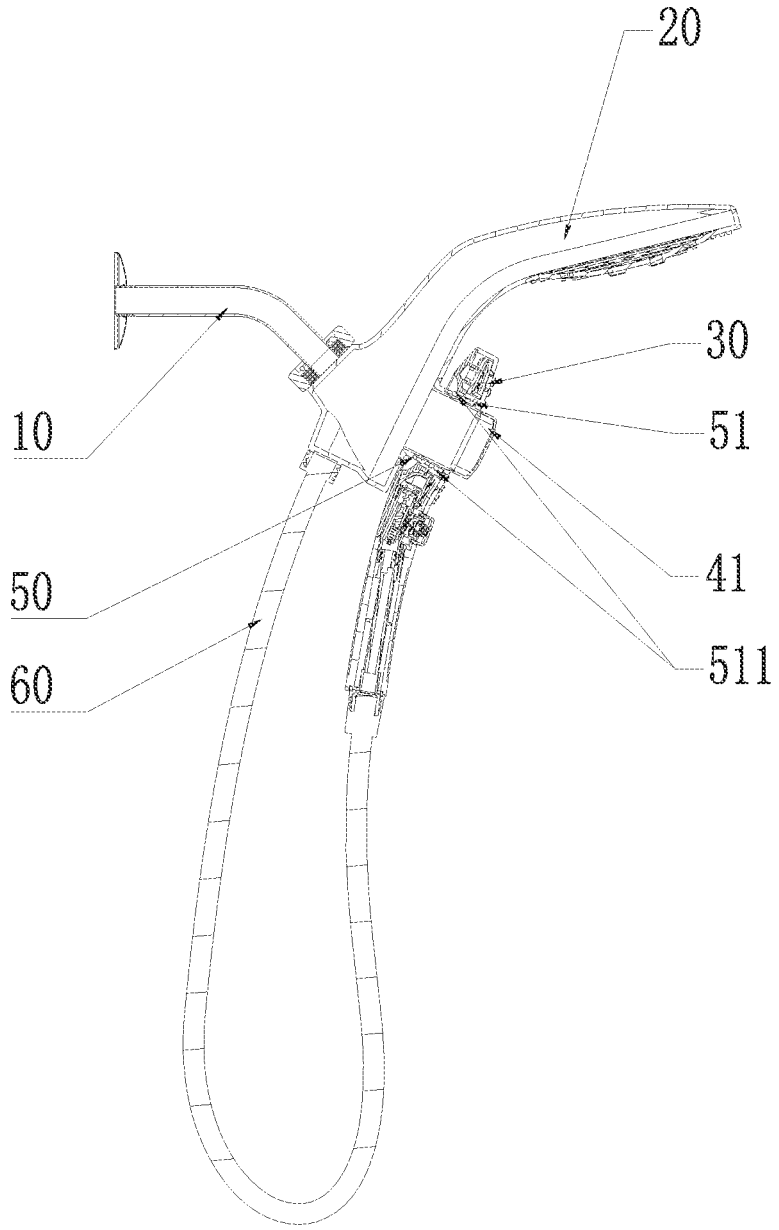
FIG. 2 is a cross-sectional view of an overall structure of the hand-held shower mounted onto the over-head shower according to Embodiment I of the present invention.

Referring to FIG. 2, the damping portion 51 is fixedly provided on the peripheral wall of the mounting ring 50. The damping portion 51 is made of a flexible material, preferably, a rubber.

The damping portion 51 may be sleeved on the mounting ring 50 or may be formed through a secondary injection molding based on the mounting ring 50. In addition, a plurality of friction ribs 511 are provided on the damping portion 51.

Specifically, the central hole 31 is provided on the face cover of the hand-held shower 30. The central hole 31 may be sleeved on the periphery of the mounting ring 50, that is, the damping portion 51 is in interference fit with the central hole 31 on the hand-held shower 30 under the friction force of the friction ribs 511, so that the hand-held shower can be firmly sleeved on the mounting ring or can be used by hand after being separated from the mounting ring.

Figure 3:
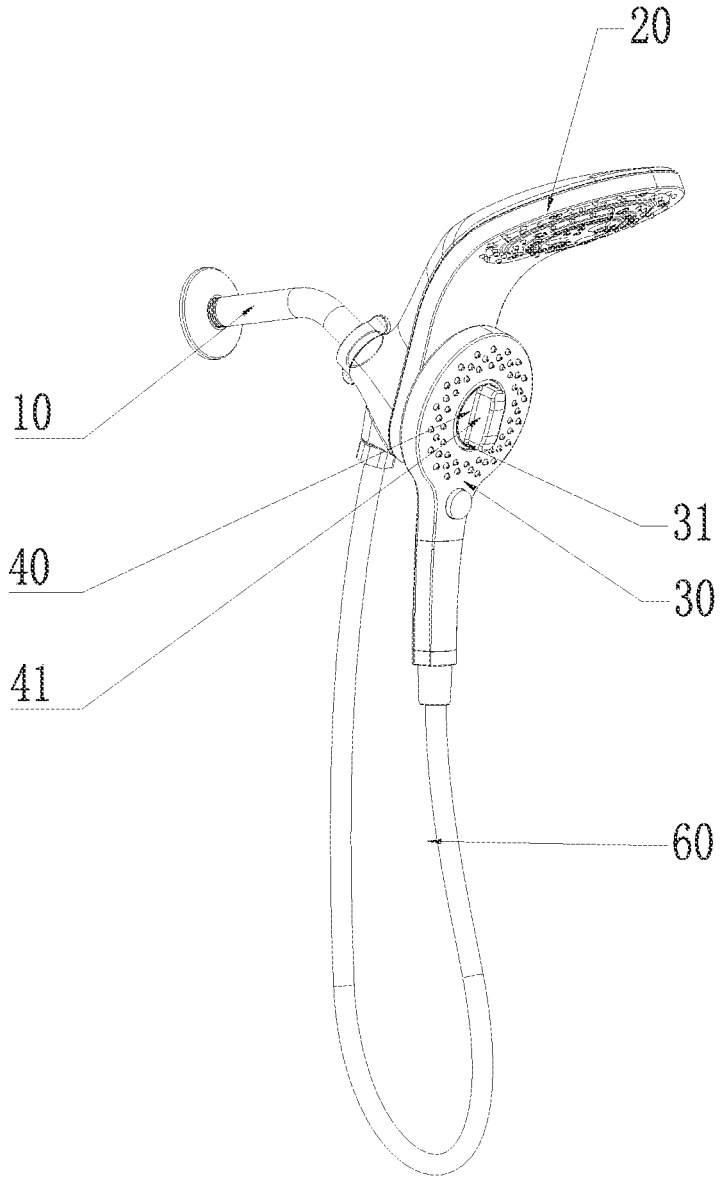
FIG. 3 is a schematic diagram of the overall structure of the hand-held shower mounted onto the over-head shower according to Embodiment I of the present invention.

Referring to FIG. 3, according to the above technical solution of Embodiment I, the hand-held shower 30 and the over-head shower 20 can be installed only through the wall-mounted supporting arm 10. In this way, the structure is simple and easy to use. Additionally, the mounting ring 50 and the damping portion 51 can stably fix the hand-held shower 30 on the wall-mounted supporting arm 10, so as to prevent the hand-held shower 30 from falling to the ground and ensure the long-term normal use of the hand-held shower 30.

Preferred Embodiment II of the Present Invention

Figure 4:
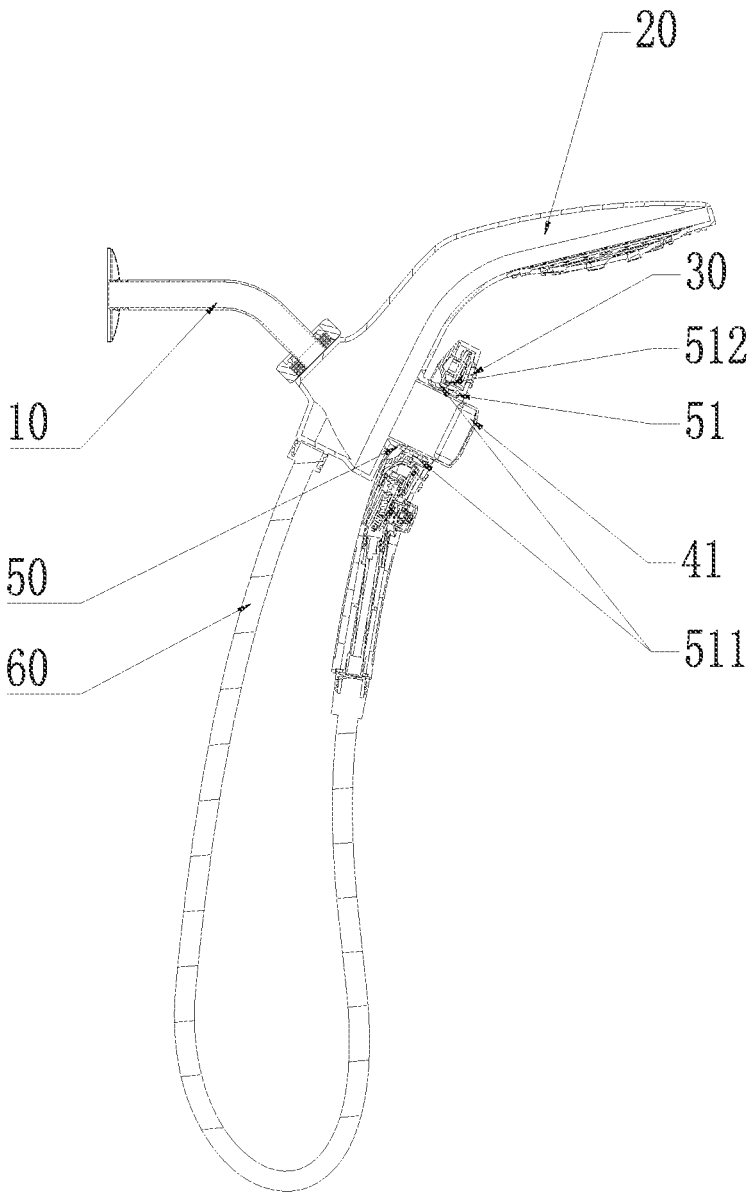
FIG. 4 is a cross-sectional view of the overall structure of the hand-held shower mounted onto the over-head shower according to Embodiment H of the present invention. 10. wall-mounted supporting arm; 20. over-head shower; 30. hand-held shower; 31. central hole; 40. switching button; 41. handle; 50. mounting ring; 51. damping portion; 511. friction rib; 512. magnetic block; and 60. hose.

Referring to FIG. 4, the damping portion 51 mentioned above may also be made of a magnetic material, and the central hole 31 of the hand-held shower 30 is provided with the magnetic block 512, such a magnet or an iron block. Single magnetic block 512 may be provided, or a plurality of magnetic blocks 512 may be provided in the central hole 31 at intervals. The magnetic block 512 magnetically cooperates with the damping portion 51, so that the hand-held shower 30 is stably fixed on the over-head shower 20 to prevent the hand-held shower 30 from falling to the ground.

The above description illustrates and describes preferred embodiments of the present invention. As mentioned above, it should be understood that the present invention is not limited to the form disclosed herein, which should not be regarded as the exclusion of other embodiments, but can be used for various other combinations, modifications, and environments, and can be modified through the above teaching or the techniques or knowledge of the related fields within the scope of the concept of the present invention. In addition, the modifications and changes made by those skilled in the art without departing from the spirit and scope of the present invention shall fall within the scope of protection of the appended claims.

What is claimed is:

1. A combined shower, comprising a wall-in supporting arm, an over-head shower, and a hand-held shower; wherein the over-head shower is fixed on the wall-in supporting arm;

the hand-held shower is detachably fixed on the over-head shower through a hose;

a switching button is provided on the over-head shower; and the switching button is configured to selectively switch on the over-head shower or the hand-held shower, wherein a mounting ring is provided at an end of the over-head shower, wherein the end of the over-head shower is positioned away from a wall;

the switching button is rotatably arranged in the mounting ring; and a top end of the switching button is provided with a handle, wherein the hand-held shower is provided with a central hole; and the hand-held shower is sleeved outside the mounting ring through the central hole.

2. The combined shower according to claim 1, wherein a damping portion is fixedly provided on a peripheral wall of the mounting ring; and the damping portion is made of a flexible material or a magnetic material.

3. The combined shower according to claim 2, wherein the damping portion is provided with a plurality of friction ribs.

4. The combined shower according to claim 3, wherein the damping portion is sleeved on the mounting ring, or the damping portion is formed through a secondary injection molding; and the damping portion is in interference fit with the central hole.

5. The combined shower according to claim 4, wherein the damping portion is made of a rubber material.

6. The combined shower according to claim 2, wherein a magnetic block is provided in the central hole; and the magnetic block magnetically cooperates with the damping portion made of the magnetic material.

* * * * *